United States Patent [19]

Best

[11] Patent Number: 4,785,552

[45] Date of Patent: Nov. 22, 1988

[54] CONVECTION STABILIZED RADIANT OVEN

[76] Inventor: Willie H. Best, 18C The Heritage, Columbia, S.C. 29201

[21] Appl. No.: 70,898

[22] Filed: Jul. 8, 1987

[51] Int. Cl.[4] ..... F26B 3/30

[52] U.S. Cl. ..... 34/30; 34/39; 34/68; 432/209; 432/148

[58] Field of Search ..... 34/39, 68, 243 C, 40, 34/41, 30; 432/209, 212, 213, 148; 118/642, 643; 427/372.2, 444

[56] References Cited

U.S. PATENT DOCUMENTS 3,813,216 5/1974 Baur et al. ..... 432/202

4,546,553 10/1985 Best ..... 34/68

*Primary Examiner*—Henry A. Bennet

*Attorney, Agent, or Firm*—Hurt, Richardson, Garner Todd & Cadenhead

[57] ABSTRACT

A housing open at both ends has opposed concaved radiant emitter walls which are disposed on opposite sides of a conveyor for defining a drying chamber through which the conveyor moves freshly coated objects. Heated air from a closure is fed to outer cavities in the housing and this air passes inwardly through nozzle ports in partition plates to impinge and heat the walls. A major portion of the air returns to be reheated in the closure. Fresh air is introduced, in heat exchanging relationship to the heated air, to ducts which discharge into the drying chamber. Overhead fans selectively circulate turbulent or laminar air in the drying chamber. Air is withdrawn from both the drying chamber and the outer cavities via over head exhaust ducts. A computer and sensors control the temperature of the emitter walls by controlling the heating of the heated air. The computer and a sensor in the drying chamber controls the temperature of the air in the drying chamber to the same or a lower temperature than the wall temperature. Methods of drying paint or other coatings are disclosed wherein the ambient temperature of the air is controlled as to velocity and temperature and the temperature of radiant walls is controlled.

38 Claims, 10 Drawing Sheets

CONVECTION STABILIZED RADIANT OVEN

BACKGROUND OF THE INVENTION

This invention relates to a radiant oven and is more particularly concerned with a high efficiency convection stabilized radiant oven and a process of drying coated objects.

Infrared energy has been used for years as a form of energy to cure or dry coatings. The fuel source has usually been electricity or gas. In most designs of infrared ovens, gas burners or electric elements were usually used to produce the infrared radiation. These burners or electric elements usually operated in a temperature range from 1200° F. to 3000° F. A typical gas fired infrared burner of this type is described in my U.S. Pat. No. 3,277,948 (Radiant burner utilizing flame quenching phenomena). Because of the high energy levels generated at these temperatures, the burner surface area (radiating emitting surface) was usually small compared to the total area of the processed parts or material. Usually reflective material was mounted between the burners or electric elements to reflect the radiant energy which was not absorbed by the processed parts or material being dried or cured. As the reflectors aged and became soiled their reflective qualities decreased and the oven efficiency rapidly decreased.

In the past I have developed the HIGH HEAT TRANSFER OVEN of U.S. Pat. No. 4,235,023 which generates high turbulence adjacent to the painted or coated objects being dried by using spaced overhead fans dispersed along a tunnel oven so that air is directed in a turbulent condition against successive objects moved beneath successive fans. A part of the air which returns to each fan is reheated. Thereafter, I developed the RADIANT WALL OVEN AND PROCESS OF DRYING COATED OBJECTS of U.S. Pat. No. 4,546,553 in which opposed curved walls direct infrared radiant heat against successive coated or painted objects passed through an oven chamber, the walls being heated by turbulent air directed by fans against the back sides of these curved walls. The heated air thereafter was passed along the inside surfaces of the curved walls and a blower withdrew the air from the chamber. The primary drying achieved in the oven of U.S. Pat. No. 4,235,023 was through convection heating while the primary drying achieved in the oven of U.S. Pat. No. 4,546,553 was through radiant heating.

My prior art Radiant-Wall Oven used individual curved walls coated with a high emissivity coating which produced a shape factor very nearly equal to 1. Depending upon the emitter temperature, heat was transferred to the coated or painted object such as a vehicle body at almost any rate desired.

My ovens of U.S. Pat. Nos. 4,235,023 and 4,426,792 are used in many applications, especially where coated metal parts are involved, and they are also used extensively for curing coatings on furniture, automobile and truck bodies.

One disadvantage of this, my prior art Radiant-Wall Oven, is that in a pure heat transfer environment by radiation, the absorbing body (object) will continue to increase in temperature with time until its surface temperature approaches that of the emitting surface. Also, since infrared radiation is in the electromagnetic spectrum, it behaves exactly as light. Depending upon the shape of the part, object or substrate containing the coating to be dried, it would be most difficult to achieve absolute uniform surface temperatures in a pure radiant heat transfer system, simply because it would be difficult for each portion of the surface to receive an equal amount of incident radiant energy. When curing a coating on the interior surface of a vehicle, the problem of transferring the heat uniformly becomes even more complex and difficult. However, it should be noted that, in a radiant heat transfer system in which the shape factor is very nearly 1, uniform heat distribution can be maintained on the primary surfaces of a vehicle or part. Therefore, it is possible to achieve complete curing of exterior coatings on such objects using low intensity radiation, only.

Included in the prior art is an oven developed by me which combined into the Radiant-Wall Oven of U.S. Pat. No. 4,546,553, fans along the roof of the oven. This prior art oven had no conveyor system and was used for in situ drying of the paint on individual automobiles whose bodies had been lengthened or otherwise modified that would require them to be repainted. The process included disposing a single automobile with wet paint in the oven in a stationary position beneath the fans. Therefore, the paint was dried to a tack-free condition using only the radiant heat generated by the curved walls and the fans then came on to provide the final cure. In this oven design, the hot gases that are used to first heat the emitting wall are discharged into the oven cavity and there is not a means of providing simultaneous control of the emitter surface temperature and the air temperature. In fact, in this type of oven there is no direct control of the internal ambient temperature and the final curing conditions are determined from trial and error.

The development of the oven of the present invention provides an apparatus and method by which highly efficient heat transfer by infrared radiation is used while, at the same time, the equilibrium temperature of the surface of an object in the oven is controlled and the variation of temperature distribution is minimized through the use of air movement within the controlled chamber. This is accomplished, in the present invention, by applying air circulation over the radiant heat transfer surface and circulating the air at a lower temperature within the oven enclosure.

I have found that, using the present invention, the ambient air contained within the radiant heat transfer environment of the oven can be substantially lower in temperature than the emitter walls and the desired surface temperature of the vehicle body, part, object or substrate. Not only can the ambient temperature be lower, but for known emitter and ambient temperatures the equilibrium surface temperature of an object such as a freshly painted vehicle body can be very accurately predicted by a numerical method for digital computation. Thus, the oven design of the present invention provides the flexibility for controlling the levels of radiation and the ambient temperatures simultaneously. The combination of controlling these two heat transfer modes creates a multitude of heat transfer conditions. This feature is extremely beneficial, considering the vast number of curing cycles which now exist, and provides the flexibility for curing future coatings, especially water based and powder types of coatings.

In the oven of the present invention, the simultaneous control of the radiant energy emission and the ambient temperature of the air surrounding the processed object surfaces provides a family of heat transfer conditions that will ensure an exact and predictable equilibrium surface temperature of an object. Since a combination of the exchange of energy is created by the use of radiant energy and convection, the desired surface temperature of the object can be achieved by transferring most of the energy through radiation, therefore allowing the ambient temperature within the heat transfer environment to be less than the desired surface temperature of the object. In fact, as the radiant energy is absorbed by the object's surfaces that increase their temperature at a level higher than the surrounding ambient temperature, energy is exchanged between these surfaces and the ambient air. In other words, the air surrounding the object surfaces then starts a cooling process of the surfaces creating a final stabilized surface temperature that is in equilibrium with the radiant energy absorbed and the energy given up to the atmosphere of the oven by convection. This phenomena is explained by the following derivation of the equations that combine the heat transfer modes of radiation and convection.

HEAT TRANSFER RATE FROM RADIATION:

$$Qr = FSEA(T_E^4 - T^4)$$

WHERE: $F$ = SHAPE FACTOR
$S$ = CONSTANT $0.171 \times 10^{-8}$
$E$ = EMISSIVITY
$A$ = AREA RECEIVING RADIATION
$T_E$ = TEMPERATURE OF EMITTER °$R$
$T$ = TEMPERATURE OF PART °$R$

HEAT TRANSFER RATE FROM CONVECTION:

$$Qc = hA(T_a - T)$$

WHERE: $h$ = FILM COEFFICIENT
$A$ = AREA EXPOSED TO CONVECTION
$T_a$ = AMBIENT TEMPERATURE

ENERGY CHANGE RATE:

$$E = MC_p \frac{dT}{dt}$$

WHERE: $M$ = MASS OF PART
$C_p$ = SPECIFIC HEAT OF PART
$\frac{dT}{dt}$ = RATE OF PART TEMPERATURE CHANGE RATE HEAT ADDED TO PART = RATE INTERNAL ENERGY CHANGE OR $Qr + Qc = E$ THEREFORE $FSEA(T_E^4 - T^4) = hA(T_a - T) = MC_p \frac{dT}{dt}$ LET $C_1 = \frac{hA}{FSEA}$ $C_2 = -(T_E^4 + C_1T_a)$ $C_3 = -\frac{hA}{C_1MC_p}$

COLLECTING TERMS AND SIMPLIFYING:

$$\frac{dT}{dt} = C_3(T^4 = C_1T + C_2)$$

FACTORING $T^4 + C_1T = C_2$ TO ALLOW INTEGRATION BY PARTS:

$$\frac{T^4 + C_1T = C_2}{T^2 + B_1T = B_2} = T^2 - B_1T + (B_1^2 + B_2) + R$$

-continued

WHERE $R$ IS THE REMAINDER:

$$R = [(B_1B_2 + C_1) - B_1(B_1^2 - B_2)]T = C_2 - B_2(B_1^2 - B_2)$$

CHOOSING $B_1$ & $B_2$ SO THAT $R = 0$ $$\text{THEN } B_1^2 = \left[\frac{C_1^2}{2} + \left[\frac{C_1^4}{4} + \left(-\frac{4}{3}C_2\right)^3\right]^{\frac{1}{2}}\right]^{\frac{1}{3}} + \left[\frac{C_1^2}{2} + \left[\frac{C_1^4}{4} - \left(-\frac{4}{3}C_2\right)^3\right]^{\frac{1}{2}}\right]^{\frac{1}{3}}$$

$$B_2 = \frac{B_1^3 - C_1}{2B_1}$$

SINCE $$T^4 + C_1T + C_2 = (T^2 + B_1T + B_2)(T^2 - B_1T + (B_1^2 - B^2))$$

$$\frac{1}{T^4 + C_1T + C_2} = \frac{AT + B}{T^2 + B_1T + B_2} + \frac{CT + D}{T^2 + B_1T + (B_1^2 - B_2)}$$

$$\text{WHERE } B = \frac{2B_2 - 3B_1^2}{4B_1^2B_2 - 3B_1^4 - 4B_2^2}$$

$$A = \frac{1}{2B_1B_2} - \left(\frac{B_1^2}{2B_1B_2} - \frac{1}{B_1}\right)B$$

$$C = -A$$

$$D = \frac{1}{B_2} - \left(\frac{B_1^2}{B_2} - 1\right)B$$

REWRITING THE ORIGINAL EQUATION:

$$\frac{dT}{dt} = C_3(T^4 = C_1T + C_2)$$

or $$C_3dt = \frac{dT}{T^4 + C_1T + C_2} = \frac{(AT + B)dT}{T^2 + B_1T + B_2} + \frac{(CT + D)dT}{T^2 + B_1T + (B_1^2 - B_2)}$$

INTEGRATING BY PARTS YIELDS $$t = N_1\text{LOG}\frac{f_1(T_2)}{f_1(T_1)} + N_3\text{LOG}\frac{f_2(T_2)}{f_2(T_1)} + \frac{N2}{2}\text{LOG}\frac{f_3(T_2)}{f_3(T_1)} + N_4[f_6(T_2) - f_6(T_1)]$$

-continued

WHERE: $t$ = TIME IN OVEN $T_2$ = FINAL PART TEMPERATURE $T_1$ = INITIAL PART TEMPERATURE $f_1(T) = T^2 + B_1T + B_2$ $f_2(T) = T^2 + B_1T + B_1^2 - B_2$ $$f_3(T) = \frac{2T + B_1 - [B_1^2 - 4B_2]^{\frac{1}{2}}}{2T + B_1 - [B_1^2 - 4B_2]^{\frac{1}{2}}}$$

$$f_6(T) = \text{ARCTAN}\frac{2T - B_1}{[4(B_1^2 - B_2) - B_1^2]^{\frac{1}{2}}}$$

$N_1 = A/2C_3$ $N_2 = (2B - AB_1)/[C_3 - (4B_2 - B_1^2)]$ $N_3 = C/2C_3$ $N_4 = (CB_1 + 2D)/C_3[4(B_1^2 - B_2) - B_1^2]$

THIS PRECEDING SOLUTION ASSUMES $$\frac{C_1^4}{4} + \left(-\frac{4}{3}C_2\right)^3 \text{ IS POSITIVE.}$$

AND $(4B_2 - B_1^2)$ IS NEGATIVE AND $[4(B_1^2 - B_2) - B_1^2]$ IS POSITIVE. THESE COVER MOST NORMAL CONDITIONS. OTHER SOLUTIONS ARE DERIVED SIMILARLY WITH THE FOLLOWING RESULTS:

1. BOTH $(4B2 - B_1^2)$ AND $(4B_1^2 - B^2) - B_1^2$ ARE POSITIVE.

$$t = N_1\text{LOG}\frac{f_1(T_2)}{f_1(T_1)} + N_3\text{LOG}\frac{f_2(T_2)}{f_2(T_1)} + N2\ f_5(T_2) - f_5(T_1) + N_4f_6(T_2) - f_6(T_1)$$

2. $4B2 - B_1^2$ IS POSITIVE AND $(4B_1^2 - B^1) - B_1^2$ IS NEGATIVE.

$$t = N_1\text{LOG}\frac{f_1(T_2)}{f_1(T_1)} + N_3\text{LOG}\frac{f_2(T_2)}{f_2(T_1)} + N2\ f_5(T_2) - f_5(T_1) + \frac{N_4}{2}\text{LOG}\frac{f_4(T_2)}{f_4(T_1)}$$

3. BOTH $(4B2 - B_1^2)$ AND$4(B_1^2 - B^2) - B_1^2$ ARE NEGATIVE.

$$t = N_1\text{LOG}\frac{f_1(T_2)}{f_1(T_1)} + N_3\text{LOG}\frac{f_2(T_2)}{f_2(T_1)} + \frac{N_2}{2}\text{LOG}\frac{f_3(T_2)}{F_3(T_1)} + \frac{N_4}{2}\text{LOG}\frac{f_4(T_2)}{f_4(T_1)}$$

The solution to the equation is graphically demonstrated in FIGS. 11, 12, and 13. FIGS. 11, 12 and 13 demonstrate that for a known and controlled ambient temperature along with a known and controlled emitter temperature that an object surface temperature is achieved and maintained accurately and predictably at a constant amount. In other words, a specific advantage of this type of oven is that the part temperature remains uniform after it has reached its equilibrium temperature regardless of the exposure time. In a pure radiant oven, if the time cycle was extended for instance due to a conveyor stoppage, the surface temperatures would rise until the final equilibrium temperature would be that of the walls themselves. In a convection oven, forced or free, in the event the processed time is extended the part continuously increases in temperature until it approaches the air temperature contained within the oven. Since in an oven of the present invention, the ambient temperature can be considerably lower than the desired object surface temperature, a final equilibrium temperature can exist that will remain constant independent of exposure time. This obvious benefit results from the total energy exchange within the oven environment being in equilibrium.

FIG. 12 is a curve that demonstrates the family of conditions between the emitter temperature and the ambient temperature which will provide for a constant object surface temperature. As an example, if a part temperature of 200° F. was desired, it could be achieved by using an emitting temperature of 200° F. and ambient temperature of 200° F. The exact same condition could also be created by using an emitter temperature of 300° F. and an ambient temperature of approximately 100° F. The advantage of being able to maintain a constant surface temperature of an object becomes apparent when the object processed is a vehicle possibly containing plastic and/or glass parts. In many instances, these types of parts are deformed from excessive heat if there is a line stoppage during the curing cycle. In an oven of this invention, the final equilibrium temperature that would prevent damage to various surfaces can be predicted and maintained.

In the oven of the present invention, millions of therms of energy can be saved because of the large decrease in energy level of the exhaust gases. In a conventional oven, to achieve a part temperature of, for example, 325° F., the oven would normally be operated at least at a temperature of 350° F. Therefore, all of the exhaust gases would probably be discharged at the higher energy level. In my present oven, the same desired surface temperatures can be achieved with an ambient temperature, much lower.

In a conventional 150 ft. oven the air exhaust rate would probably be 6,000 CFM. If the temperature of the exhaust gases were lowered 150° F., by using the oven of the present invention almost 1,000,000 Btu/Hr. would be saved. When the energy saved from one oven is translated into the energy that could be saved for an entire finishing system, the total becomes very impressive.

Another source of energy savings in the oven of this invention is due to the fact that the end losses to, i.e., heat losses through the entrance and exit ends of the oven, are greatly decreased due to the lower operating ambient temperature in the oven environment. In a conventional oven operating at 350° F. where air seals are used on the ends of the oven, the end losses can be as much as 800,000 Btu/Hr. depending upon the oven height. Contrary to popular belief, air seals, in most instances, increase the heat loss from an oven as opposed to decreasing it. The air seals decrease the temperature of the air that may escape from the end openings by dilution but usually the heat loss from the oven is increased due to the air movement at the interface of the oven with the ambient conditions exterior to the oven. No air seals are required on my present oven simply because the oven can be operated at a much lower ambient temperature and the infrared radiation can be contained in the central heating chamber.

The theory of the present invention is that most solids are opaque to nearly all thermal radiation, and therefore the emission (or absorption) of radiation takes place within a very thin surface layer (usually less than 0.0003" of the exterior of the surface). A notable exception to this is glass, which, although a solid, is transparent to short wave length thermal radiation (light) but is opaque to longer wave length radiation emitted by bodies at any temperature lower than that required to produce light. Liquids and gases, as well as some other solids are transparent to a greater or lesser degree. However, the primary concern is the absorption of radiation in a liquid coating. Experiments under my direction have shown that most coatings absorb all of the incident radiation within an extremely thin surface layer. Heat, transferred in the form of convection or conduction, requires a physical medium for transporting the energy from a high temperature source to a low temperature sink. Since radiant heat transfer can take place in a vacuum, it is evident that no heat transporting medium is required to transfer energy by infrared radiation. Unlike convection heat transfer where the energy is actually imparted to the surface from a physical medium, when a body absorbs infrared radiation the heat is actually generated within a very thin layer of the absorbing surface. It is widely accepted that the heat generated is due to a random motion imparted to the atoms and molecules that have absorbed the incident radiant energy.

In my present oven, I heat by using infrared radiation and using convection as a stabilizer. Thus, my present oven provides a heat transfer environment in which the ambient temperature does not have to be greater than the desired part temperature and in many instances can be considerably less. In most conventional convection ovens the operating temperature has to be substantially greater than the desired part surface temperature.

In the oven of the present invention the ambient temperature in the central heating chamber or environment of the oven can be several hundred degrees less than the desired part temperature and the ambient air actually acts to cool the surface of an object as opposed to heating the surface. A key element to the thermal efficiency of my present oven is the amount of energy that is consumed and not the operating temperature.

My oven is designed to include large radiating walls or surfaces directly opposed from one another. The remaining surfaces, i.e., top and bottom surfaces within the oven environment are usually reflective and have low emissivities. Therefore, all of the internal cavity surfaces of the oven are either emitting surfaces or reflective surfaces. The transmission losses from the heat generating source behind the radiant walls and the reflective surfaces is usually negligible due to the insulated panels behind these walls, so that the total energy consumed is essentially independent of the emitting surface temperature. In other words, since both emitting surfaces are at the exact same temperature, the exchange of energy between these two surfaces is equal. Since in my oven most of the radiation that falls upon a reflector will eventually be directed back onto the emitting surface, then the radiant exchange within the oven is in equilibrium and no appreciable radiant energy escapes the oven enclosure. This would be the case if the emitter surface temperatures were, for example, operating at 300° F. or 800° F. Therefore, only when an external body, at a lower temperature than the walls, is placed between the walls does any appreciable exchange of energy occur. Furthermore, essentially only that amount of energy that is absorbed by the external body is transferred from the system. All other radiant energy continues to be interchanged equally within the oven enclosure.

Air within the oven environment is maintained at a lower temperature than the desired part or object surface temperature and obviously is maintained at a temperature less than the emitting surface temperature. Those parts or objects in the central chamber will stabilize at a precise temperature above the ambient temperature and below the emitter surface temperature. However, it is important to recognize that here again, the total energy consumed is only that energy that is transferred to the external part. Therefore, the energy required for the part or object to reach the desired curing temperature is essentially independent of the ambient temperature.

Accordingly, it is an object of the present invention to provide an oven and process for rapidly and more uniformly drying paint on freshly painted surfaces on successive objects.

Another object of the present invention is to provide an oven for drying coatings on successive objects which oven is inexpensive to manufacture, durable in structure and efficient in operation.

Another object of the present invention is to provide an oven in which rapid drying of coatings on successive objects can be achieved at substantially lower oven air temperatures.

Another object of the present invention is to provide an oven and process for drying coatings on objects in which a clean essentially dust free environment is provided.

Another object of the present invention is to provide an oven for drying coatings on successive objects, the oven operating at lower air temperatures than conventional ovens.

Another object of the present invention is to provide an oven and process for drying coatings on successive objects using a minimum amount of heat.

Another object of the present invention is to provide an apparatus and process for automatically drying coatings on successive objects in which the exchange of heat between the oven and the ambient air in a plant is minimized.

Another object of the present invention is to provide an oven and process for drying coatings on objects, which will maximize the heat transfer and fuel efficiency of the oven.

Another object of the present invention is to provide an oven and a process for drying coatings on objects, which will reduce to a minimum the contamination from particulate matter and products of combustion.

Another object of the present invention is to provide an oven for drying coatings on objects in which the amount of energy transferred by infrared radiation and convection can be independently and simultaneously controlled.

Another object of the present invention is to provide an oven in which the temperature of the exhaust gas is substantially less than in other convective type ovens.

Another object of the present invention is to provide an oven which is modular and can be readily and easily expanded so as to provide different drying conditions when the assembly line in which the oven operates is modified.

Another object of the present invention is to provide an oven which is readily and easily shipped in a prefabricated condition and can be installed by semi-skilled laborers.

Another object of the present invention is to provide an oven which will provide essentially no adverse effects on the color of the coating which is being dried.

Another object of the present invention is to provide an oven which can be readily and easily cleaned.

Another object of the present invention is to provide an oven which can maintain, within very small tolerances, the equilibrium temperatures on the exterior surface of objects which pass through the oven.

Another object of the present invention is to provide an oven that will maintain a constant equilibrium temperature on the surface of objects, independent of time, to insure that sensitive coatings or materials will not be harmed if there is an interruption of the conveyance means.

Another object of the present invention is to provide an oven which be readily adapted to accommodate future coatings, such as water based and powder type paints.

Another object of the present invention is to provide an oven in which there is no need for air seals at the ends of the ovens.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENTS

Figure 1:
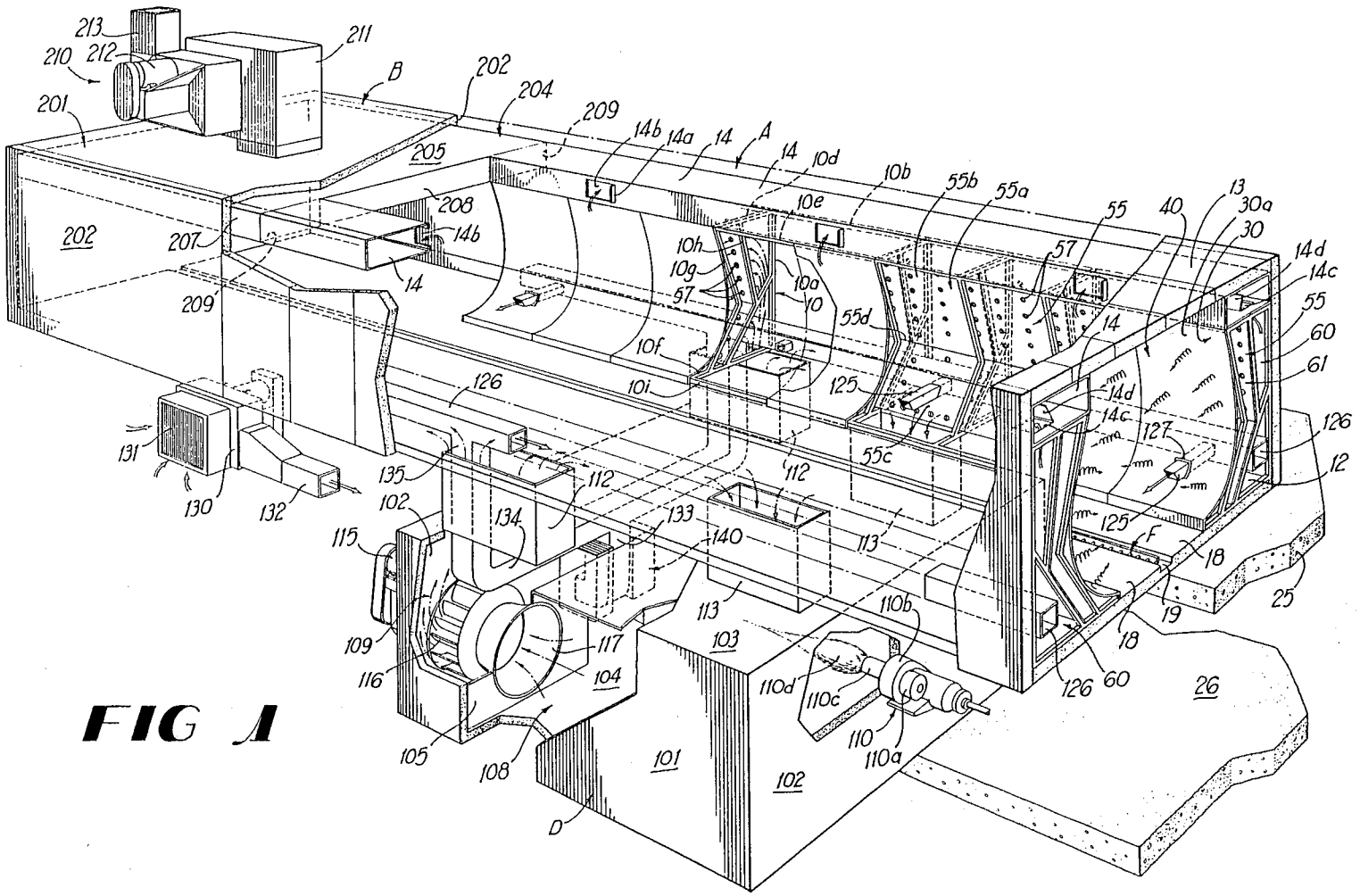
FIG. 1 is a perspective view, partially broken away of an oven constructed in accordance with the present invention.

Referring now in detail to the embodiments chosen for illustrating the present invention, the oven of the present invention, as shown in FIG. 1, includes a central tunnel oven body A provided with both an entrance and an exit vestibule, such as vestibule B. Below the central oven A is a heating furnace D which supplies the heated air for the oven. Freshly coated or painted objects C, such as automobile parts formed of sheet steel, are carried through the oven along a linear path by successive dollies E which are moved by a conveyor chain F.

The oven body A is symmetrical along a vertical centerline which intersects the linear part of conveyor chain F. The oven is modular in construction so that the oven body A can be constructed of any number of juxtaposed side modules.

Figure 3:
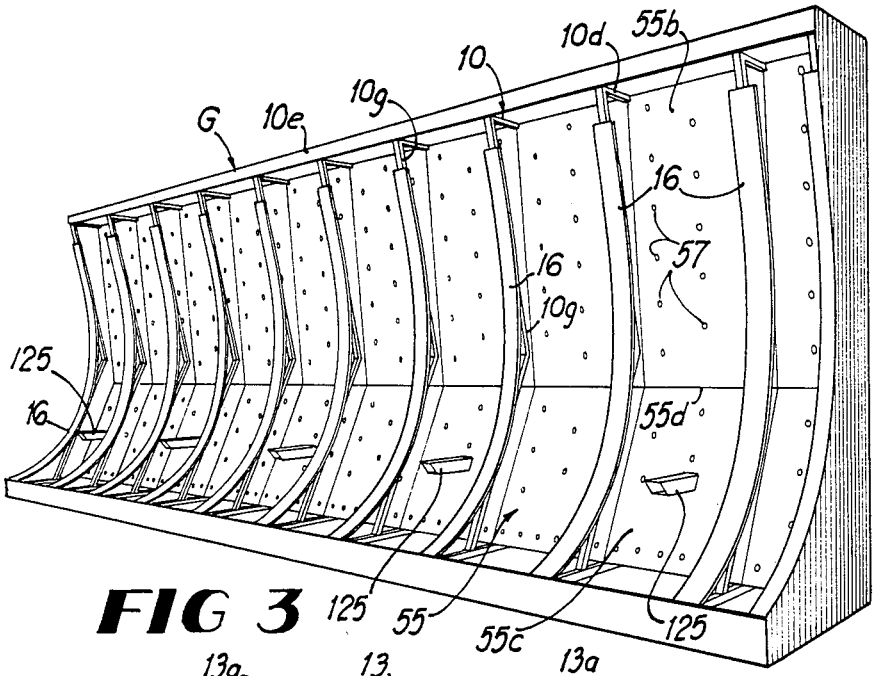
FIG. 3 is a perspective view of a detail showing the side module of the oven disclosed in FIG. 1.
Figure 4:
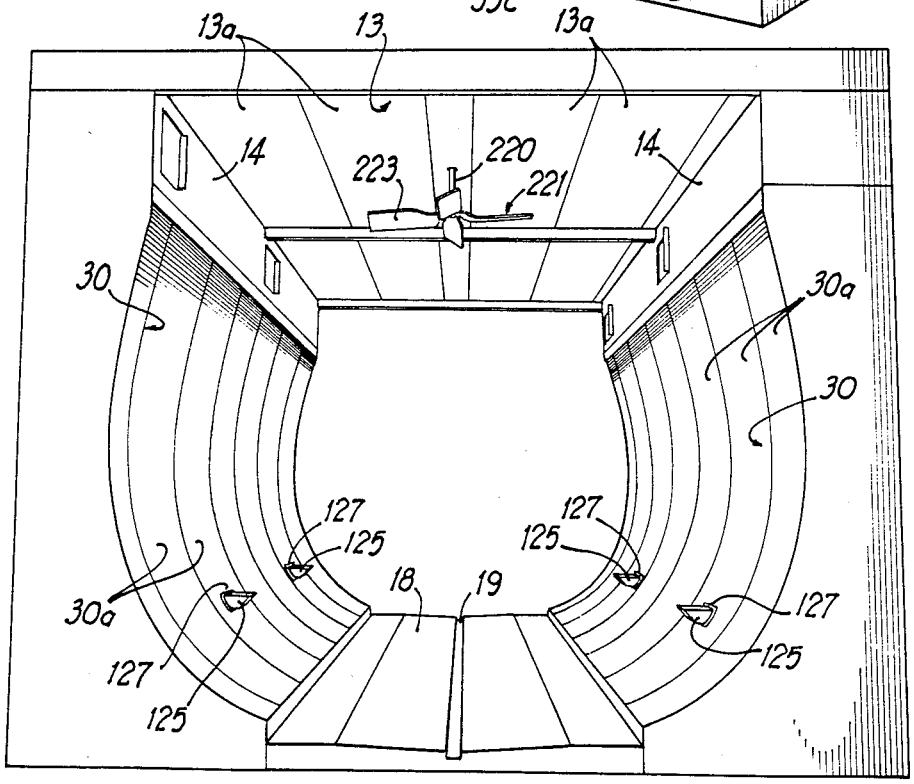
FIG. 4 is a front perspective view of a module of the oven shown in FIG. 1.

The oven body A is formed of one or more pairs of opposed, complimentary, side modules G. Each side module G has a main framework 10 which forms the support for the side walls 11 of the oven A. This framework 10 includes a plurality of equally spaced, parallel, upright struts **10*a*, the ends of which are joined by longitudinally extending upper outer beam 10*b* and longitudinally extending lower outer beam (not shown). Support beams 10*d* respectively extend forwardly from the upper ends of struts 10*a* to an inner upper longitudinal beam 10*e*. Floor beams 10*f* extend inwardly from the lower ends of the struts 10*a*. Between each support beam 10*d* and floor beam 10*f* are a pair of transversely spaced, dog-leg, longitudinally aligned struts, the outer nozzle plate supporting struts 10*h* and the inner emitter wall supporting struts 10*g*. The lower beams 10*f* protrude inwardly beyond the inner struts 10*h*, the inner ends of these beams being joined by an inner lower longitudinal floor beam 10*i*, seen in FIG. 3**.

In assembling the side module G, the longitudinally extending, fresh air supply duct or header 126 which has transversely disposed, longitudinally spaced, inwardly extending fresh air discharge ducts 125 are welded in place to the bottom portions of the upright struts **10*a*. The function of these ducts 125 and 126** will be described, later.

After installing the ducts 125 and 126, the outer rectangular side 11 is welded to the upright struts **10*a* and then the bent nozzle diffuser plates 55 are successively welded in edge-to-edge fashion to the outer dog-leg plate supporting struts 10*h*. Furthermore, a bottom sheet metal skin 12 is welded to the bottom of the framework 10 and the end walls 15 are welded at the ends of framework 10. Next, individual, preshaped, curvilinear, emitter supporting strips 16 are welded to the inner struts 10*g***.

Figure 6:
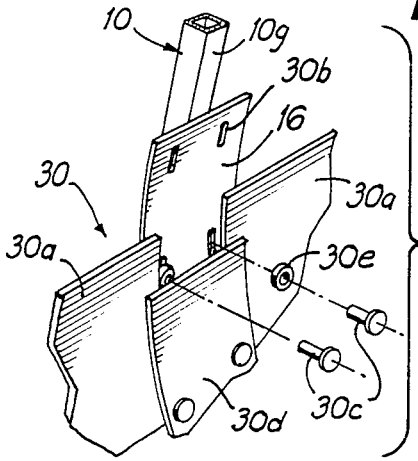
FIG. 6 is an enlarged perspective view of a portion of the oven substantially along line 6 in FIG. 4.

The strips 16 are provided with opposed pair of vertically elongated rivet receiving slots **30*b*. In assembling wall 30, individual rectangular, curved radiant emitter element or plates or wall 30*a* are positioned with their abutting edges over strips 16 to form wall 30. The method of mounting the plates 30***a*, as illustrated in FIG. 6, provides for each plate 30*a* to be free floating. This is accomplished by placing a preformed, outer, rectangular, curvilinear, mounting strip 30*d* to overlap the abutting edges of adjacent plates 30*a* with spacers 30*e* between the edges of plates 30*a* and strips 16, a spacer for each of the slots 30*b*. Rivets 30*c* are then inserted through the overlapping edges of mounting strips 30*d* and plate 30*a* and then through the spacers 30*e* and into slots 30*b* of the internal mounting strips 16. The exterior mounting strip 30*d* is also porcelainized and the rivets 30*c* used are stainless steel for reflecting the radiant energy.

Trim collars 127 are then added around the fresh air discharge ducts 125 which protrude through the walls 30*a* to ensure a tight and uniform fit.

Figure 5:
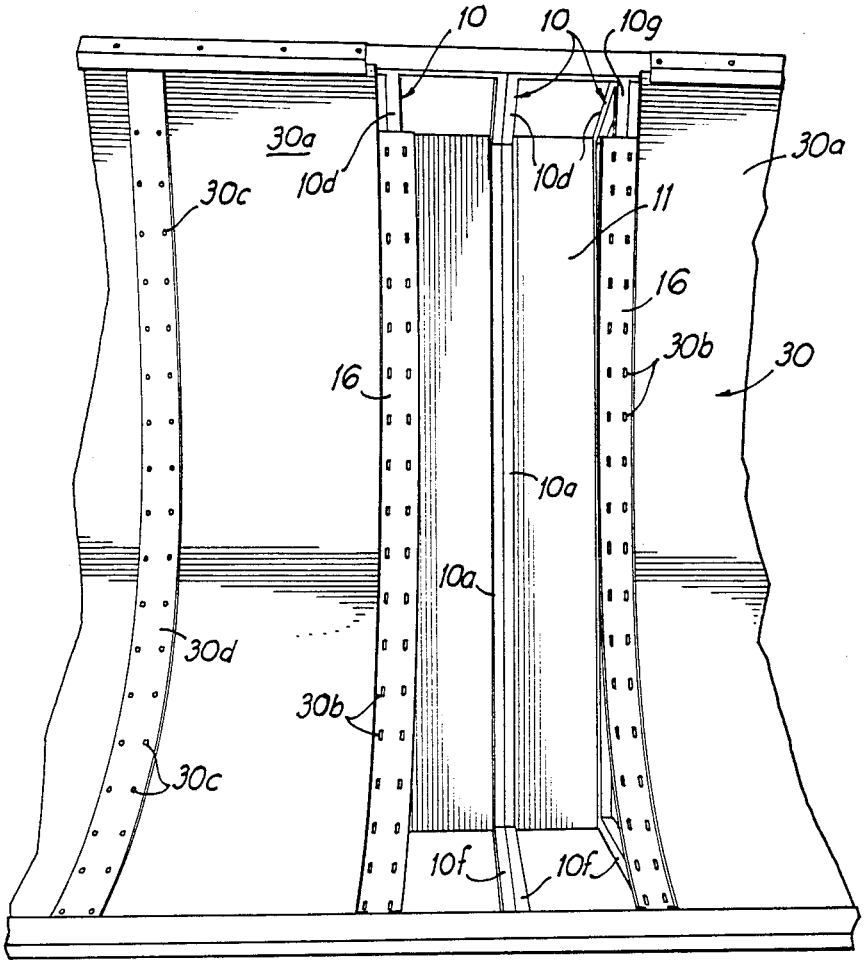
FIG. 5 is a fragmentary vertical elevational view of a portion of the oven depicted in FIG. 1, showing the joining of two side modules together.

When joining two side modules G end-to-end together, the end walls 15 and struts 10*g* and 10*h* are omitted at the adjacent ends and the framework 10. The abutting portions of the modules G are arranged together, as shown in FIG. 5 and welded in place. Thereafter, an appropriate width of emitter plate 30*a* is installed over the connecting end portions of the modules G.

After the side modules G are assembled, the air exhaust ducts 14, having longitudinally spaced ports 14*b*, with slidable dampers 14*a*, are installed over the tops of the side modules G. Ports 14*c* in ducts 14 open into outer plenum cavities 60. Ports 14*c* respectively have dampers 14*d* for adjusting the size of the opening of ports 14*c*. Ducts 14 withdraw air from the central drying chamber 40 through ports 14*b* and from outer plenum chamber 60 through ports 14*c*.

Cross beams 13*a* are secured between the exhaust ducts 14 and support roof 13 which is installed over the cross beams 13*a*.

Thereafter, a central floor plate 18 is disposed between the spaced opposed beams 10*i* at the bottom of the module G, this floor plate 18 having a central straight linear chain trough 19 along the longitudinal centerline of the oven body A. Trough 19 receives the moving conveyor chain F, by means of which spaced successive dollies or upright supports E are moved progressively through the oven, the supports E respectively carrying objects C which are to be passed through the environment of the body A. The objects C are such items as furniture or automotive parts or panels or other substrates on which a wet or tacky coating 23, such as paint, lacquer or enamel is disposed. Drying or curing of the wet coating 23 progressively occurs in the oven body A as the objects C are moved through the oven.

When the oven body A is assembled, the plates 30*a* form a pair transversely opposed, outwardly curved, radiant, emissive walls, or emitters 30 which curve generally about spaced, straight, horizontal, longitudinally extending, parallel axes which are above the floor panel 18 on opposite sides of the center plane and within the central drying chamber. Thus, the maximum intensity upper infrared rays from walls 30 are directed downwardly and inwardly; and the maximum intensity lower infrared rays are directed upwardly and inwardly to converge toward each other, with the maximum intensity central rays being directed horizontally, inwardly. The lower end portions of the radiant walls 30 respectively terminate curved to a greater extent than the upper portions and beneath the object C.

The floor plate 18 is infrared reflective and spaces the bottom portions of the walls 30 apart from each other. The top or roof 13 is also infrared reflective and, with spaced walls 30 and the bottom plate 18, define, for the oven environment an open ended, linear, hollow tubular, longitudinally extending central drying or curing chamber 40.

The curvature of each radiant emission plate 30*a* is generally arcuate in a vertical dimension, being concaved along its inner surface and convex along its outer surface throughout its vertical dimension. These plates 30*a* when assembled are aligned with each other longitudinally and are transversely opposed. The curvilinear or vertical dimension, of walls 30 measured along the curved portion of the surface of the element or wall 30 should be greater than the height of the object C. The length of each wall 30, longitudinally, should be substantially greater than the longitudinal dimension of the object C and extend substantially the length of the housing.

The inner concave emitter surfaces of the walls 30 are preferably coated with porcelain enamel. The radiant energy of maximum intensity or rays travel inwardly in a direction perpendicular to the tangent of the radiating increment and will converge toward an imaginary tunnel through which object C travels, this tunnel extending longitudinally of the ovens and above the floor or floor plate 18, throughout the length of the oven body A. Thus, the heat, radiating from one radiant walls 30 will either be absorbed by the other wall 30 or by an object C or be reflected by the roof 13 or floor plate 18 until it is absorbed.

The inner surfaces of the entire radiant walls 30 i.e., plates 30*a* and strips 30*d*, as pointed out above are coated with porcelain enamel having a high emissivity.

This porcelain has high heat emitting characteristics (high emissivity) that is from about 0.9 to approximately 0.95 and forms a continuous emitting coating or surface film 41 for each of the walls plates 30*a*. Other high emissivity material can be substituted for the porcelain enamel forming the surface film 41. Also, oxidizing the surface can improve the emissivity.

Between each wall 30 and its adjacent side wall 11 is the wall heating chamber for that wall 30. Within each of these wall heating chambers is disposed the nozzle diffuser plate 55. Each nozzle diffuser plate 55 is made up of a plurality of rectangular plates or panels 55*a* bent along a straight line parallel to the upper and lower ends of the panels 55*a*, to an obtuse angle to conform generally to the curvature of the wall 30. Thus, there is a flat upper panel portion 55*b* and a flat lower panel portion 55*c* joined along a common edge 55*d* which extends in a horizontal longitudinal direction. The plates or panels 55*a* are arranged in a juxtaposition with the respect to each other, being joined along their abutting edges to form an essentially continuous partition which separates each of the heating chambers into a closed, outer plenum cavity 60 and a closed, inner turbulent air, wall heating cavity 61.

The panels 55*a* are provided with a plurality of vertically and horizontally spaced holes 57 which are preferably arranged in vertical rows, evenly spaced longitudinally from each other. There are usually more holes 57 along the bottom portion of each plate or panel 55*a* so that enough heat is generated by the bottom portion of wall 30 to dry the underside of an object C. The metal surrounding each hole 57 is deformed inwardly so as to form an inwardly protruding, truncated, cone shaped inwardly directed funnel or nozzle 57*a* which surrounds that hole 57.

For supplying heated air to the two outer plenum cavities 60 the air heating assembly or furnace D is preferably disposed below the main floor 25 which supports the oven body A. In the present embodiment, this heating assembly of furnace D is on a floor 26 below floor 25 and includes an air heating closure or furnace 100 formed by a pair of spaced, parallel, vertically opposed, side panels 101, the ends of which are joined by a rear panel 102 and a front panel 103. The closure 100 also includes a top panel 103 and bottom panel 104. Inwardly of the panel 102 are two L-shaped transversely spaced vertically disposed partitions 105, the main plates of which are parallel to panels 102 and 103 so that the partitions separate the closure 100 into an air heating compartment 108 in which air returning to the closure 100 is heated and two transversely spaced, but interconnected air pressure chambers 109, in the corners of closure 100, and in which the air, that has been heated, is pressurized and directed up through transversely opposed, upstanding, heated air, discharge ducts 112 in the top plate 103 and into the cavities 60.

Mounted in the central portion of the panel 103 is a conventional gas burner assembly 110, this burner assembly consisting, externally of panel 103, of a motor 110*a* which drives a blower 110*b* for directing air into a burner nozzle 110*c*. The nozzle 110*c* projects through the panel 103 and is connected to a source of fuel, such as natural gas or propane gas, for producing a combustible mixture which is directed into compartment 108 for creating a flame 110*d* within the heating compartment 108.

The top place 103 is also provided with a pair of upstanding, transversely opposed, air return ducts 113 which communicate with cavities 61. Air in cavities 61 is discharged into the compartment 108 through the air return ducts 113.

Mounted on the rear wall 102 are a pair of motor assemblies, such as a motor assembly 115, which drive a pair of compressor or centrifugal blowers, such as centrifugal blower 116. The intake of blower 116 communicates through an air intake conduit or sleeve 117 in each partition 105, with air heating compartment 108. The blowers, such as blower 116, provide for the pressurizing of the air into compartments 109 and, thence, up through the ducts 112 and into the outer plenum cavities 60. This heated air then travels through the holes 57, inwardly into cavity 61 so as to impinge upon the outer sides of the walls 30 to heat these walls for producing infrared radiation within central chamber 40. The air, then travels through the return ducts 113 into compartment 108 and is heated by the flame 110*d* of burner assembly 110, within the chamber 108.

For relieving the build up of pressure, due to the introduction of air and fuel by the nozzle assembly 110, and for providing heat to the vestibules B, discharge ports 14*c* are provided in the bottom portion of the ducts 14 opening into outer cavities 60. Movable plates 14*d* pivotally mounted inside the duct 14 permit incremental closing of holes 14*c*, respectively, to balance the removal of excess air.

The inwardly directed, transversely opposed, longitudinally spaced, pairs of fresh, heated air, discharge ducts or conduits 125 which arranged, generally, horizontally and protrude through the nozzle plates 55 and the emitter walls 30, have inner ends which open into the bottom portion of the drying chamber 40. As pointed out above, the outer ends of the conduits 125 communicate with the longitudinally extending fresh air supply ducts or headers 126 which are respectively within the outer cavities 60. Each header 126 extends throughout substantially the entire length of the oven body A and serves the dual purpose of providing a secondary heat exchanger for heating the fresh air and conduits for supplying the fresh air itself to the conduits 125.

Figure 2:
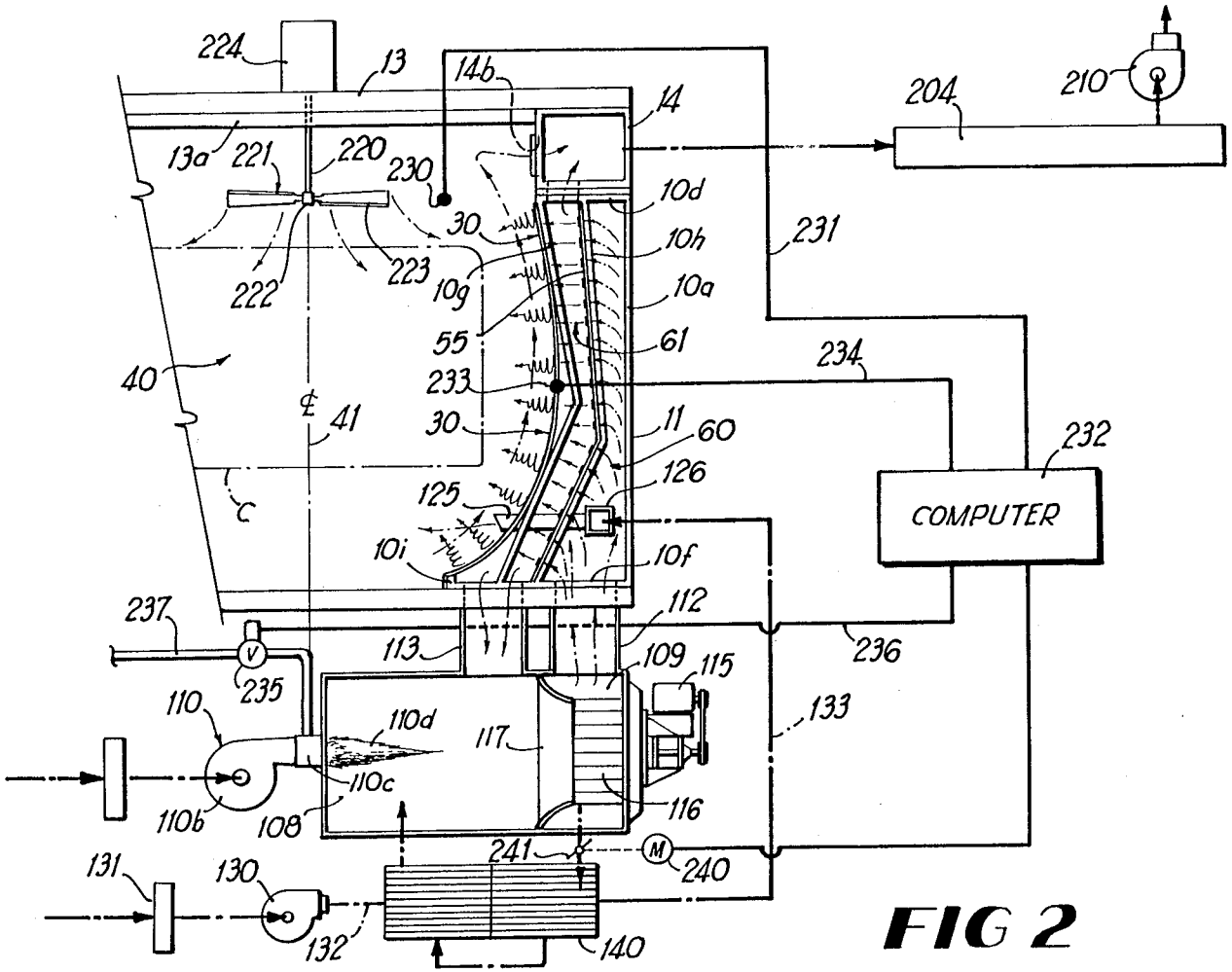
FIG. 2 is a schematic vertical sectional view of a portion of the oven shown in FIG. 1 and the electrical schematic therefor.

For supplying the heated fresh air to the ducts or headers 126, a blower 130, seen in FIGS. 1 and 2 draws air, through a filter 131 and discharges this filtered air into an air supply duct 132. The air supply duct 132 delivers this air into a primary heat exchanger 140 and, thence, upwardly through an air supply duct 133, into the central portion of a transversely disposed air distribution duct 134, the outer ends of duct 134 curving upwardly to provide vertical air delivery ducts 135 which respectively connect to the central portions of the ducts or headers 126. The incoming fresh air is heated to appropriate temperature by air, discharged from chambers 109 down past the heat exchanger tubes 140*a* into the bottom of chamber 108. Thus the discharge ducts 125 discharge filtered, fresh, dust free, heated, air transversely into the bottom portion of drying chamber 40. This air is subsequently removed through the longitudinally spaced ports 14*b* in ducts 14 and, thence, along the air discharge ducts 14.

The entrance and exit portions of the ovens may or may not be provided with one or two vestibules, such as the vestibule B illustrated in FIG. 1. This vestibule B in FIG. 1 indicates an entrance vestibule and has an inverted U shaped outer housing 201 formed of a pair of opposed upright side panels 202 and a top panel 203. Below substantially the entire top panel 203 is an exhaust system including air chamber or plenum 204 which is defined by a lower plate 206, sides plates 207 and end plates, such as end plate 208. Within the inner end plate 208 are rectangular openings which receive the end portions of the ducts 14, when the vestibule B is assembled against one end of the oven 10.

Mounted on the roof or top 203 of the vestibule B is an exhaust blower 210 which is connected to a chamber 211, communicating with the interior of the chamber 204. This exhaust blower 210 is driven by a motor 212 to discharge the air from the chamber 204 through a stack 213. The blower 210 is usually operated at a rate sufficient to withdraw a volume of air corresponding to the volume of air and combustion gases introduced by the burner 110 plus the volume of air supplied to drying chamber by the blower 130.

The creation of a suction by the exhaust blower 210 in chamber 204 causes the heated air which passes through the ports 14*b* and 14*c* to heat the chamber 204 and thereby cause the air in the vestibule B to be heated with the heat of the exhaust gases. An exit vestibule (not shown) can be provided, if desired, at the opposite end of the oven. It may or may not have an exhaust system.

A plurality of longitudinally spaced fan assemblies are provided in the roof or top panel 13 of the oven body A. These fan assemblies each include a vertically disposed shaft 220 which protrudes through the roof 13, the lower end of the shaft 220 being provided with a fan 221 having a hub 222 mounted on the shaft and a plurality of equally spaced radially extending fan blades 223. Outwardly of the roof 13, the shaft is journalled for rotation and driven by a motor assembly denoted generally by numeral 224. The fan assembly is generally of the same type as shown in my U.S. Pat. No. 4,235,023 and hence a more detailed description of the fan assembly is not deemed necessary.

These fan, shafts, such as shaft 220, are preferably arranged along the vertical centerline of the oven body A so as to dispose the fans 2121 at longitudinally equally spaced locations along the length of the drying chamber 40. Thus, as the objects C are conveyed along the path of travel through the oven, each object C passes successively beneath a fan 221 so that air is directed downwardly against each object C successively. The shaft 220 enables the fan 221 to be spaced from the upper surface of the roof 13 by between 2 and 6 feet.

Preferably all the fans 221 are in a common horizontal plane while the axis of all fans are in a common vertical plane along the centerline of the oven. The space between the fans and the objects C in the oven is essentially unobstructed except for a wide grid screen (not shown) required by O.S.H.A. regulations. Thus the path of travel of the air is directed down against the wet coatings on objects C is essentially unobstructed and hence the air impinges upon the objects.

Thereafter, the air moves downwardly and then outwardly, so that some of the air passes in a sweeping motion along the inner surfaces of the radiant walls 30, thence passing upwardly to return to the backside of the fan 221. The upper path, after the air strikes the object C, is essentially unobstructed so that there is little or no vacuum drawn on the backside of the fans 220. Heated air is introduced at the bottom portion of the chamber 40, preferably below the path of travel of the object C through ducts 125 and this heated air cooperates with the radiant energy to heat and dry the bottom portions of object C and is commingled with the air returning to the fans 220. The rapid travel of the air enables the heated air 125 to be commingled progressively with the returning air and, thereby heat the air within the chamber to a prescribed but relatively lower temperature.

When the oven is fully assembled, the slide gates **14*b* are adjusted to balance the exhaust air through the full length of the drying cavity. Interior dampers 14*d* which partially cover openings 14*c* are accessible through doors (not shown) in duct 14** to adjust the amount of exhaust air to accommodate the incoming combustion air and products of combustion.

Holes (not shown) are provided in the trough 19 so that when the interior of the oven is washed, the water will readily drain from the trough 19.

In some operations, such as when drying wet paint on objects, it may be desirable to permit the parts or objects C to pass through a portion of the oven without the fans operating so that the paint is cured to a tack-free condition to assure that dust or dirt will not adhere to the coating and then the fans are operated to ensure a final cure.

Within the drying chamber 40 are one or a plurality of spaced sensors i.e., thermocouples, such as thermocouple 230, which are respectively connected by wire 231 to a computer 232. These thermocouples 230 must be shielded from the radiant energy so that they read the temperature or temperatures of the air and supply this to the computer or CPU 232. A second group of sensors i.e., thermocouples, such as thermocouple 233, are connected to the radiant wall 30 at one or a plurality of locations and the signals from the thermocouples 233 are fed, via wire 234, to the computer 232. The computer, in turn, controls a valve 235, via wires 236, so as to control and prescribe the amount of fuel, such as natural gas, supplies through a pipe 237 to the burner **110*c*. The computer 232 also controls the actuation of a reversible motor 240 connected to a damper 241 on the heat exchanger 140 to determine the extent of the path of the fresh air through the heat exchanger and therefore the temperature of the fresh air delivered to the ducts 225**.

Thus, the computer 232 controls the temperature (1) of the radiant walls 30 by the opening and closing of the control valve 235 and (2) the temperature of the fresh air being supplied via ducts 225 to drying oven 40, to thereby control the ambient temperature or oven environmental temperature within the chamber 40 through the manipulation of the damper 241 via motor 240.

The computer or CPU 240 has inputs which prescribe the temperature or the radiant walls 30 and the temperature for the ambient air in chamber 40. The output from the computer 232 depends on the input temperatures and the oven set point i.e., an input as to the desired temperature fed into the computer.

Usually it is preferable to maintain the ambient air in chamber 40 at a constant value and vary the temperature of radiant walls 40 to yield the desired part temperature for object C. The actual value of the radiant wall temperature can be computed from the set point, plus the specific oven characteristics, i.e., the heat transfer coefficient, the ambient temperature, the part shape, the oven shape, the part thickness, the part material and the coating emissivity of the coating on the wall.

The oven may, if desired, be insulated around its interior by insulation 250.

In operation, painted objects C, such as furniture or automobile parts, are carried successively from the entrance end of the oven assembly by the chains F successively through the entire length of the oven. When the freshly painted objects C pass through the vestibule B, they are gradually warmed, due to the emission of the heat from the chamber 204. Thereafter these objects C are successively passed throughout the length of the oven, as the chain F moves along the vertical centerline of the oven. Preferably the objects C are disposed symmetrically in the oven so that the object C will be spaced equally from the sides of the oven; however, this is not necessary since the drying is primarily the function of the radiant walls 40 which generate radiant heat. This radiant heat or energy is of the approximately the same intensity regardless of how far away from the radiant wall 30, the surface of the object C is located. The air supplied by the fans 221 reduces the thermal barrier of the paint to a minimum and provides for the rapid withdrawal of solvent from the surface of the paint. The radiant heat supplied by the emitter walls 30 penetrate the paint and progressively heat the paint from the surface inwardly through the paint so as to progressively dry the successive layers or increments of the paint. The effect of both the impinging air and the radiant heat is synergistic, enabling an object which contains the paint to be quite rapidly heated and quite rapidly dried.

Figure 9:
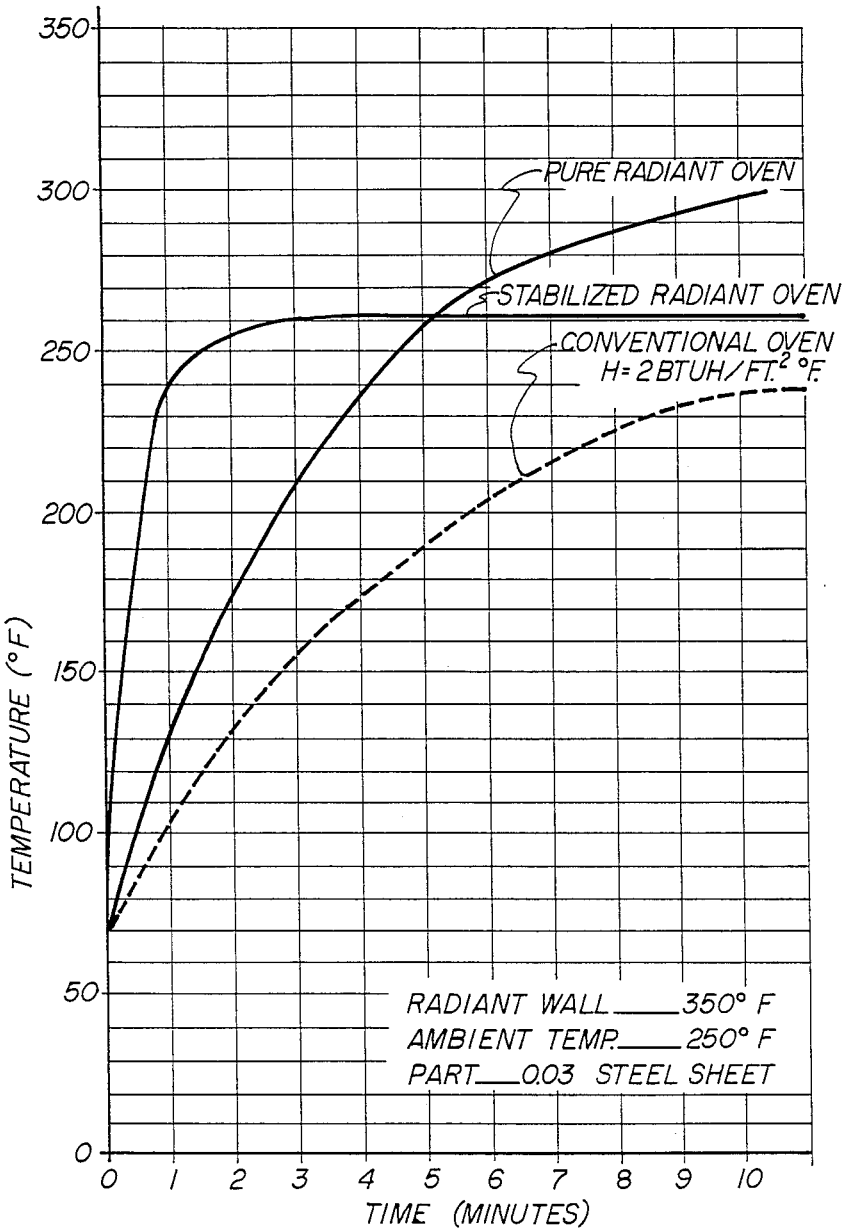
FIG. 9 is a graph showing the operating characteristics of the oven of FIG. 1 operating with a radiant emitter surface temperature of 350° F. and an ambient temperature of 250° F. compared to a pure Radiant-Wall oven disclosed in Best U.S. Pat. No. 4,546,553 operating at an emitter temperature of 350° F. and to a conventional air oven operating at a temperature of 250° F.

In FIG. 9 the oven of the present invention is compared with a conventional oven as used for drying paint on an automobile part. In the graph illustrated in FIG. 9, the part which is being dried is made of 0.03 inch steel sheet. In a conventional convection oven, the part when it enters the oven will gradually heat up according to the broken line representation. The performance of the present invention is illustrated by the two continuous lines, one line illustrating when the fans are operating and the other line illustrating when the fans are inoperative. The radiant walls will maintain a temperature of 350° F. and the ambient temperature is maintained at 250° F. From the graph of FIG. 9 it will be seen that using the fans, the part heats up to 245° within one minute and to its full heated temperature of 262° within three minutes. Thereafter the part remains at a constant temperature so that drying is relatively uniform. The broken line describes the time/temperature relationship of a convection oven operating at 250° F. with H=2 BTUH/Ft.$^2$/°F.

Figure 10:
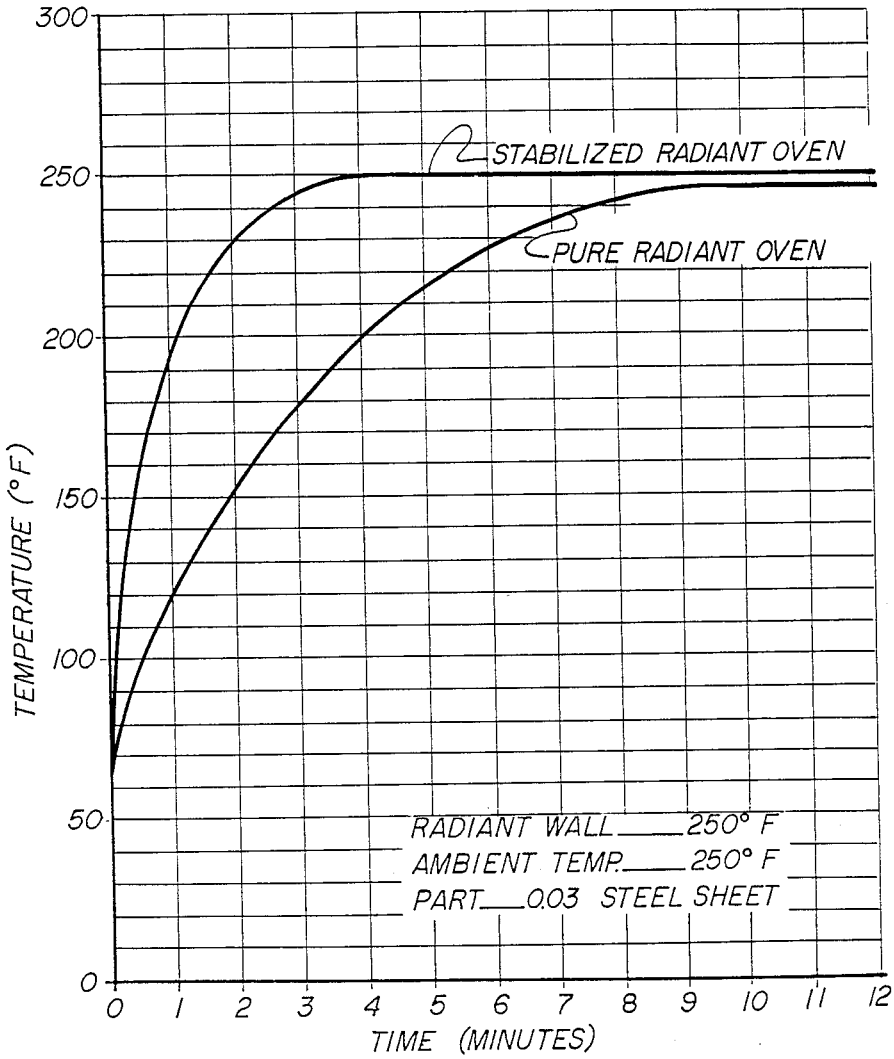
FIG. 10 is a graph comparing the performance of the convection stabilized oven of the present invention to that of a pure Radiant-Wall oven.

In FIG. 10 is shown an arrangement in which the radiant wall of the oven of the present invention is maintained at 250° F. and the ambient temperature of the oven is maintained at 250° F. Here, through use of the fans, the part is heated to its temperature of 250° within approximately 3.7 minutes whereas with the fan off, it requires 9 minutes to heat the same part to a temperature of about 245° F.

Figure 11:
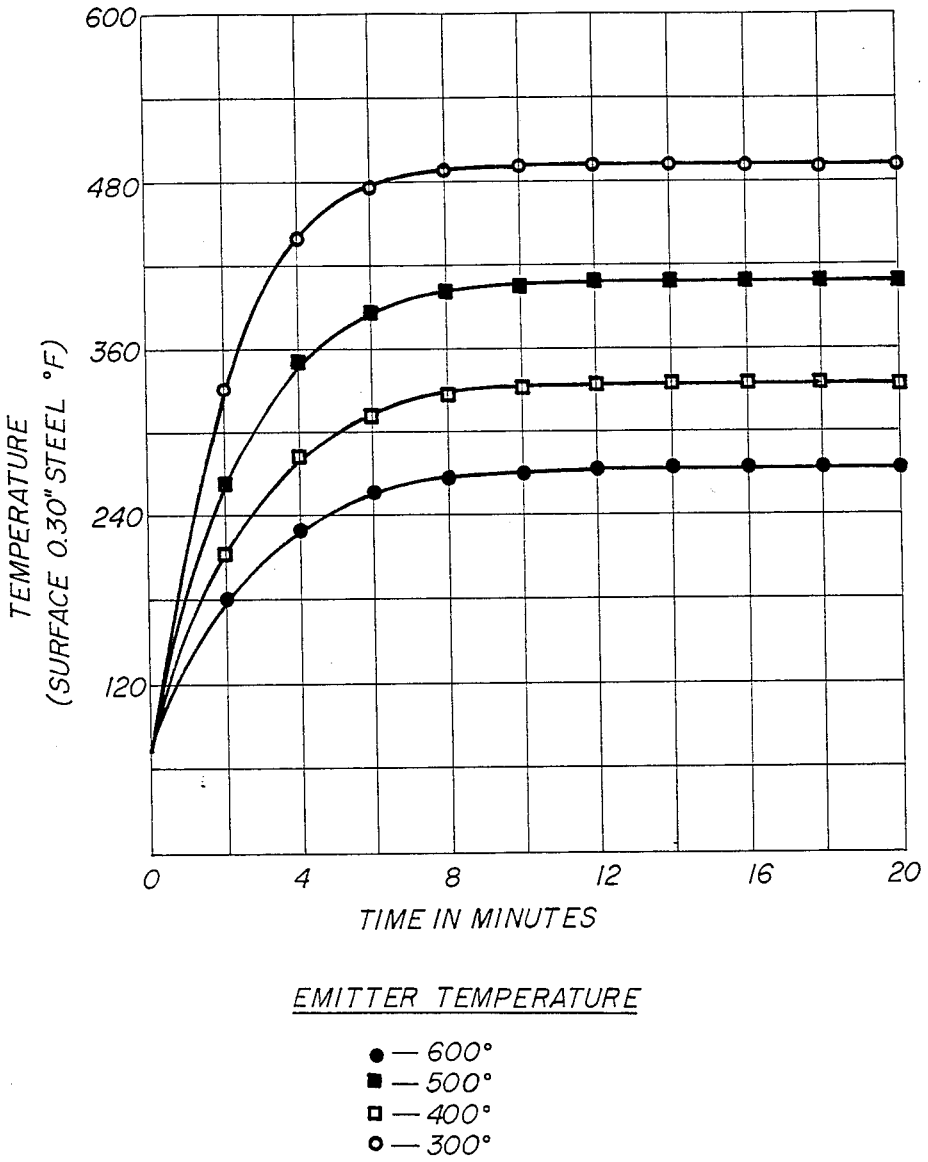
FIG. 11 is a graph of varying emitter temperatures with the air temperature held constant in the oven of the present invention.

FIG. 11 is a graph that demonstrates the final stabilized temperature of the 0.03 inch thickness steel part at various emitter temperatures. The port has a combined emissivity of 0.7, a shape factor of 0.0. The paint on the part has a film coefficient of 2. The air temperature is held constant at 250° F. and the emitter temperature is varied from 300° F. to 600° F. For each emitter temperature with a fixed ambient temperature in the oven, a final and absolute part temperature is attained and remains constant with time.

Figure 12:
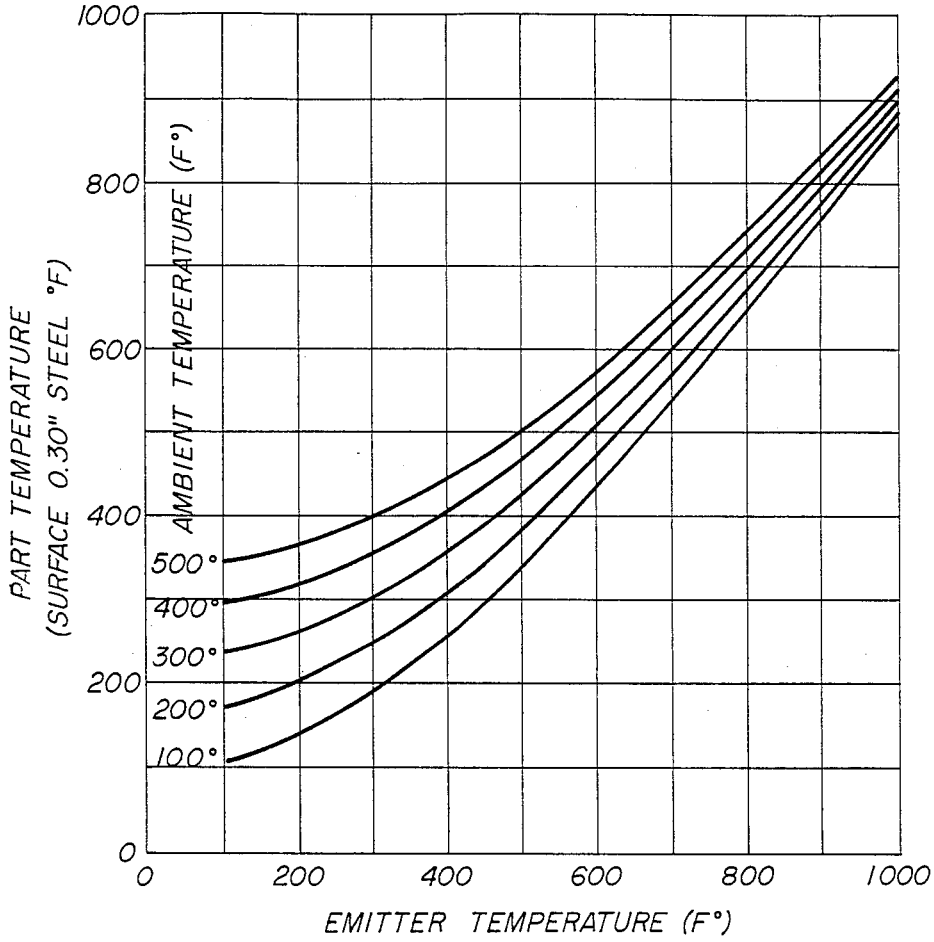
FIG. 12 is a graph showing the family of emitter and air temperatures that will provide for equilibrium object temperatures in the oven of the present invention.

FIG. 12 is a graph that shows a family of conditions of emitter temperature and air temperature that will provide a part surface equilibrium temperature. If a final part surface temperature of 400° F. is desired, it could be attained by many combinations of air and emitter temperatures. As an example, the emitter temperature could be 400° F. and the air temperature could be 400° F., or the emitter temperature could be approximately 520° F. with an air temperature of 200° F. Since the energy lost from the oven is more related to the oven air temperature, in most cases, it will be desirable to operate the oven with the lower air temperatures.

Figure 13:
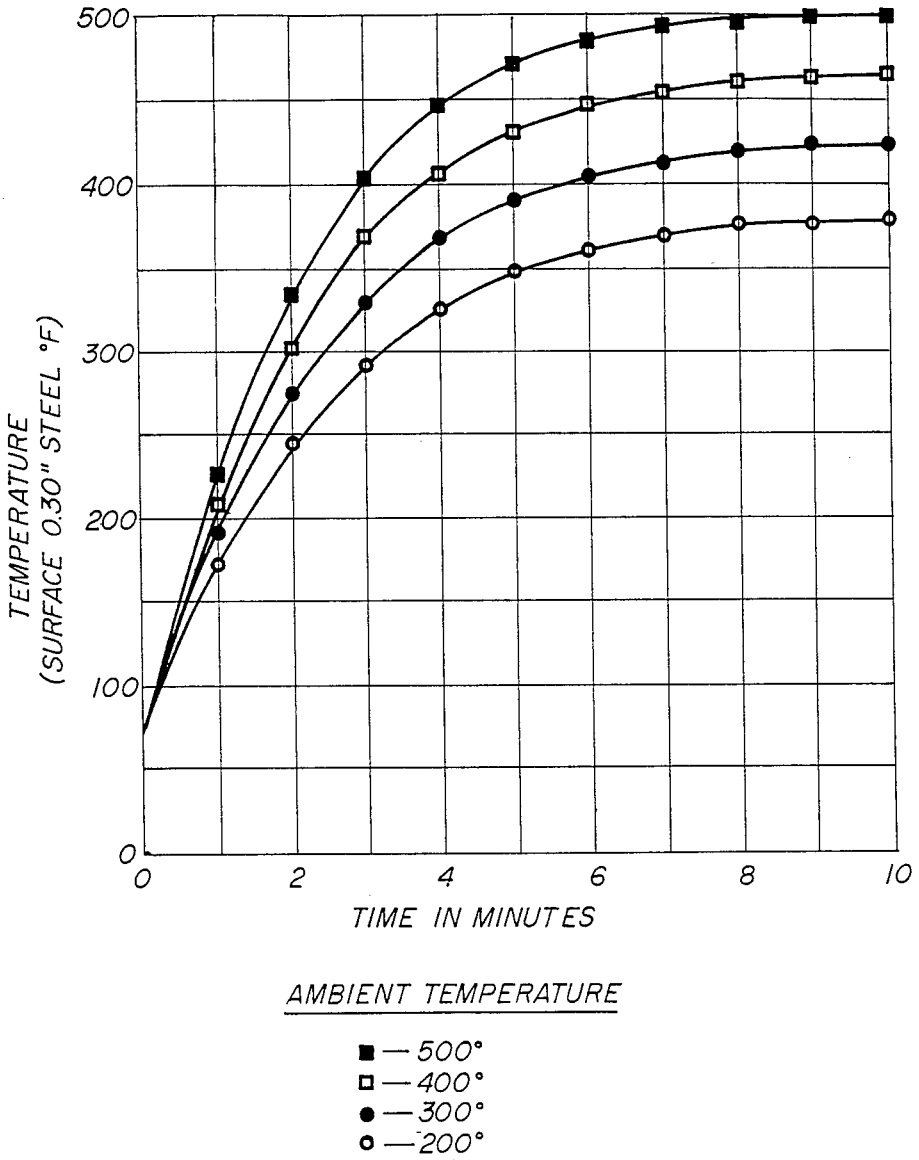
FIG. 13 is a graph of varying air temperatures with the emitter temperature held constant.

FIG. 13 is a graph that demonstrates the final stabilized temperature of the 0.03 inch thickness steel object part at various air temperatures. The part has a combined emissivity of 0.6 and a shape factor of 1. The paint on the part has a film coefficient of 2. The emitter temperature is held constant at 500° F. and the ambient temperature is varied from 200° F. to 500° F. For each air temperature with a fixed emitter temperature in the oven, a final and absolute part temperature is attained and remains constant with time.

SECOND EMBODIMENT

Figure 7:
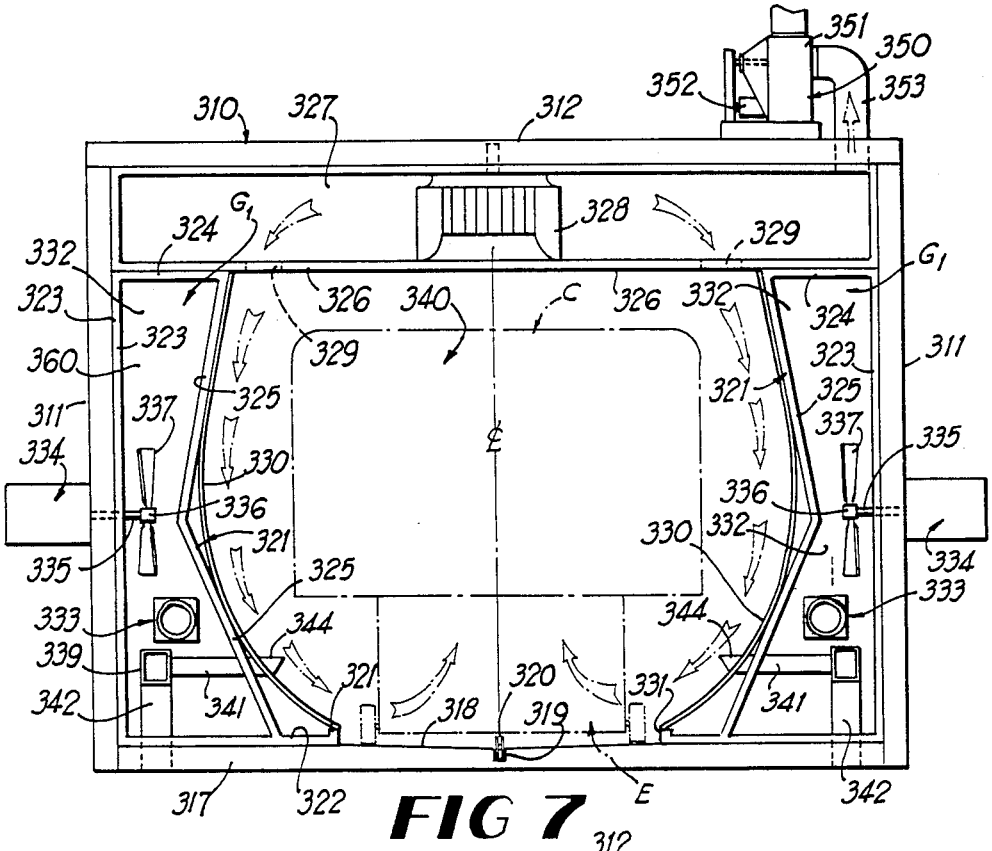
FIG. 7 is a vertical sectional view of a modified form of the present oven.
Figure 8:
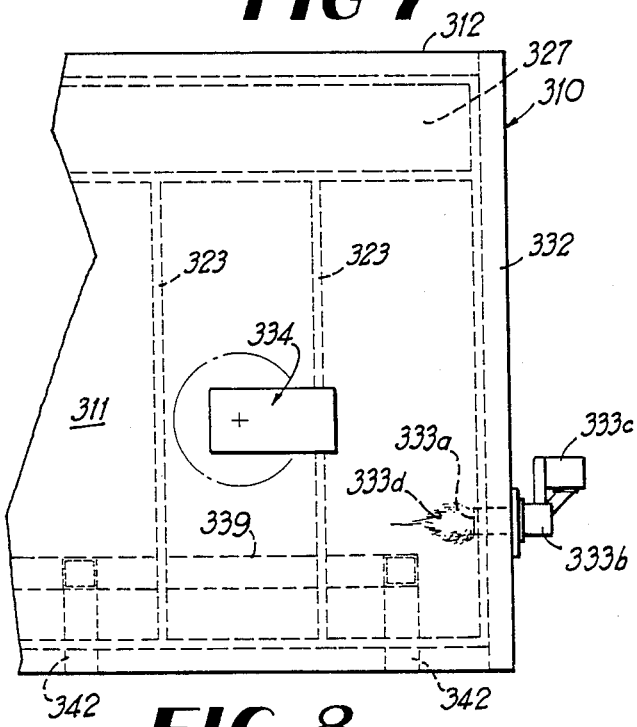
FIG. 8 is a fragmentary side elevational view of a portion of the furnace of the oven depicted in FIG. 7.

In a second embodiment of the invention, as illustrated in FIGS. 7 and 8, an oven assembly is shown which can be substituted for the oven body A. In more detail, this oven assembly includes a pair of upright opposed parallel sides 311 the upper ends of which are joined by a top or roof 312. The bottom edge portions of the the sides 311 are joined by a composite floor made up of opposed space parallel inwardly protruding bottom panels 317, the inner edge portions of which are disposed parallel to each other and adjoined by a central body panel 318. A conveyor chain 320 rides within a center trough 319 which extends throughout the length of the oven and is along the vertical centerline CL.

Within the interior of the housing is a pair of opposed frames, denoted generally by the numeral 321, these frames include bottom struts 322 which extend from the walls 311 inwardly along the bottom panels 317 and upright ribs 323 which are spaced longitudinally from each other and extend along the inner surfaces of the walls 311, the upper ends of these ribs 323 terminating in a common horizontal plane and being respectively provided with inwardly extending struts 324 which are spaced below the roof 310.

Dogleg shaped reinforcing braces 325 join the inner ends of the struts 324 with intermediate portions of the struts 322, these doglegged braces 325 including an upper portion which extends downwardly and outwardly and a lower portion which extends from the lower ends of the upper portions downwardly and inwardly, as shown in FIG. 7. Supported by these struts 324 is an inner roof or ceiling 326 which extends across the entire interior of the oven 310 so as to provide, between the roof 312 and the roof 326, a fresh air chamber or plenum 327. Within this plenum 327 are a plurality of longitudinally spaced recirculation centrifugal blowers or fans, such as blower 328, the intake of each blower 328 communicating with the interior or central drying chamber 330 of the oven through an appropriate central hole and discharging the air into the plenum 327. Adjacent to each of the fans or blowers 328 are a pair of transversely aligned, diametrically opposed holes 329 in the plate 326, the holes being disposed inwardly of the frames 321. Holes 329 permit air from plenum 327 to be discharged downwardly into chamber 340 passing along the inner surfaces of outwardly curved emitter walls 330 which are identical to the walls 30, the air being directed upwardly beneath objects C. The ends of the emitter walls 330 and their adjacent outer walls 311 are closed by end plates 332 so that essentially closed wall heating chambers 360 are defined.

For heating the air within the heating chambers 360, each end wall 332 is provided with a burner or fuel nozzle assembly 333 which is mounted thereon for direct firing into the wall heating chambers 360, respectively. In more detail each nozzle assembly 333 includes a nozzle **333*a*, a centrifugal blower 333*b* and a motor 333*c* for driving the centrifugal blower. Gas is supplied to the burner so that a flame 333*d*** is provided within the heating chamber.

Along the side walls 331 are provided a plurality of longitudinally spaced opposed fan assemblies 334, each fan assembly being provided with a horizontally disposed shaft 335 which protrudes through the side wall 311 so as to terminate within the central portion of the wall heating chamber on each side. The inner end of the shaft 335 is provided with a hub 336 of a fan which has radially extending blades 337. The shafts 335 are rotated by appropriate motors (not shown) which are disposed externally of the walls 311.

Below the fans are the longitudinally extending air headers 339 which are provided at spaced intervals with inwardly extending air ducts 341 which protrude through the lower portions of the emitter walls 330 for discharging air inwardly into the central heating chamber 340. Fresh air which has been filtered is delivered to the headers 340 through air intake ducts 342.

The air from the interior of the outer chambers 360 and the air from the interior of the central chamber 340 are withdrawn by means of an exhaust fan or centrifugal blower, denoted generally by the numeral 350, the blower 351 thereof being driven by a motor 352 for pulling this air through a duct 353 which communicate with the central heating chamber and the outer heating chambers.

In operation, the outer chambers 360 of the oven of the second embodiment are provided with the products of combustion derived from the nozzles 333 so that the air within these chambers is heated to a prescribed temperature. The fan assemblies 334 are operated so as to circulate the air within these outer chambers 360 in a turbulent condition to impinge against the inner surfaces of the radiant emitter walls 330. This heated air also heats the headers 340 so that air which is delivered through the fresh air ducts 342 into the headers 339 are, thence, delivered, at a lower temperature, inwardly through the opposed, transversely extending, discharge ducts 341 which protrude from the headers 339 through the bottom portions of the walls 340. Simultaneously, the blower or blowers 328 are operated so as to discharge air which is drawn from the central chamber outwardly into the upper plenum 327 so that the air is then discharged downwardly through the ports or holes 329, the air being heated as it moves downwardly adjacent to the curved inner surfaces of the emitter walls 330. As the air approaches the bottom portion of these walls 330, the heated air, emerging from the ducts 341 is entrained or mixed or commingled with the recirculated air so as to maintain the air of the oven environment within the central chamber 340 at a prescribed temperature. The objects, such as object C, are fed successively, in spaced relationships along the centerline of the oven from the entrance end of the oven to the exit end thereof, being subjected to successive blasts of air which, after being discharged into the central chamber, admix with heated air to impinge in an upwardly direction against the bottom surface of the object, as shown by the arrows in FIG. 7. The air, after impinging on objects C, is returned to the intake side of the associated blower 328 for recirculation. The air, laden with volatiles from the central drying chamber, is withdrawn through the exhaust by means of the exhaust fan 351 and the products of combustion and air introduced by the burners 333 are also withdrawn 351, thereby.

Infrared rays are radiated from the inner surfaces of the curved radiant walls 330 so as to be directed simultaneously against opposite sides of the object C. Due to the curvature of the walls 340, these walls being curved about longitudinally extending axis within the chamber 340, enable the radiant heat to be directed against both sides of the object and the bottom so as to dry both sides simultaneously while the air immediately after being commingled with heated fresh air, impinged on the lower side of the objects and then passes upwardly along the sides of object C and oven the top to be removed for recirculation by the blowers 328.

It will be understood that the cross-section depicted in FIG. 7 is repeated along the length of the oven, as desired so that air circulation within the outer chambers or cavities 360 is maintained by a plurality of the fan assemblies 334 arranged in a longitudinally spaced relationship along the length of the outer chambers 360.

The combination of the circulating air within the inner chamber 340 which impinges along the front and back sides of the object C as well as on the bottom surface and also impinges to a limited extent on the upper surface, tends to reduce the thermal boundary layer on the object C so as to speed up bringing the object C to a prescribed temperature for drying. Furthermore the combination of the circulating air and the radiant heat reduce the time of heating and curing the paint, enamel or lacquer on the surface of the object. Thus, dried objects emerge successively from the oven, being conveyed by the chain 320 as other objects are fed by the chain successively into the oven and along the linear path defined by the trough 319.

As pointed out above, the distances between the sides of the object C and the radiant walls 330 are not critical since radiation heat does not attenuate appreciably as it passes through air from the emitter walls 330. Furthermore, one radiant wall 330 will be at essentially the same temperature as the other radiant wall 340, due to the fact that the infrared rays generated by one wall are partially absorbed and partially reflected by the other wall unless there is an object interposed there between. Thus, between each successive object C, the walls 330 will be simultaneously heated by radiation from an opposite wall.

The ovens as described above can be operated with the air in a turbulent or laminar condition based upon the operating RPM of the fans and the volume of air recirculated. If the volume of circulated air is kept to a minimum (h is less than 2 Btu/Hr./Ft.$^2$/°F.) the air will impinge on most surfaces in a non-turbulent condition. If the recirculation of air is increased beyond a certain critical velocity, laminar or viscous flow can no longer continue and turbulence takes place. In the range of turbulent flow, enumerative eddies and cross currents occur.

The heat transfer coefficient (h) is accounted for in the derivation of the numerical solution to the combined heat transfer effects of infrared radiation and convection. In other words, the numerical solution will accommodate either forced or free convection. Whether turbulent or laminar flow is used is dependent upon the objective of the process.

As an example, if the requirement is to cure a coating readily visible to the infrared energy from the emitters (such as the exterior of a vehicle) then the air temperature and the recirculated volume of air can be kept relatively low. (h is less than 2 Btu/Hr./Ft.$^2$/°F.). However, if the curing cycle requirement is to cure a coating or sealant inside of a vehicle body, then more turbulent air flow at higher temperatures is indicated.

It will be obvious to those skilled enough that many variations may be made in the embodiments here chosen for the purpose of illustrating the present invention, without departing from the scope thereof as defined by the appended claims.

I claim:

1. A convection stabilized radiant oven comprising:
(a) a housing having an open interior;
(b) conveyor means for moving successive objects along a path of travel through said oven from its entrance end to its exit end;
(c) a pair of spaced opposed radiant emitter walls disposed within said interior of said housing and on opposite sides of said path of travel for defining a longitudinally extending drying chamber with an entrance end and an exit end, said walls directing infrared radiant energy from said radiant emitter walls inwardly toward said path of travel when said radiant emitter walls are heated;
(d) means for heating said radiant emitter walls to prescribed temperatures for causing said radiant emitter walls to emit sufficient radiant energy inwardly toward said path of travel to heat said objects as they pass along said path of travel; and (e) air control means for adjusting the temperature of the air within said drying chamber to a prescribed and controlled temperature and for moving sufficient air within said drying chamber past said objects as they are heated by said radiant energy for stabilizing the temperature to which said objects are heated by said radiant energy.

2. The convection stabilized radiant oven defined in claim 1 in which said air propelling means includes a plurality of fans disposed for discharging air against said objects successively as said objects are moved along said path of travel.

3. The convection stabilized radiant oven defined in claim 1 including exhaust means for withdrawing air from said drying chamber.

4. The convection stabilized radiant oven defined in claim 1 including a floor extending between the bottom portion of said radiant wall and a ceiling adjacent to the upper edges of said walls, said floor and said ceiling being formed of material which reflects radiant energy.

5. The convection stabilized radiant oven defined in claim 1 wherein said means for heating said radiant emitter walls includes a heating furnace for heating air therein to provide heated air, said housing being provided with cavities respectively and communicating with the outer surfaces of said walls, means for delivering said heated air into said cavities and against said outer surfaces and means for circulating said air between said furnace and said cavities for the reheating of said heated air.

6. The convection stabilized radiant oven defined in claim 5 including air exhaust means for removing a portion of the air from said drying chamber and a portion of the heated air from said cavities.

7. The convection stabilized radiant oven defined in claim 5 wherein said means for heating said air includes fuel nozzle means for introducing fuel and air into said furnace for producing products of combustion within said furnace for admixing with the air in said furnace to produce said heated air and exhaust means for withdrawing a portion of the air from said heating chamber, said portion corresponding to the volume of air and products of combustion introduced by said nozzle means.

8. The convection stabilized radiant oven defined in claim 5 including fresh air ducts for defining passageways leading from the exterior of said oven through said cavities and through said radiant walls for introducing air into said drying chamber.

9. The convection stabilized radiant oven defined in claim 8 wherein said ducts extend transversely of said oven and communicate with the bottom portions of said drying chamber for directing air transversely inwardly from opposite sides toward said path of travel.

10. The convection stabilized radiant oven defined in claim 1 including a pair of exhaust ducts disposed at the upper corners of said housing, and an exhaust blower connected to said ducts for exhausting air from said ducts, said exhaust ducts having ports opening inwardly for withdrawing air from the top portions of said drying chamber.

11. The convection stabilized radiant oven defined in claim 1 wherein said walls are curved about horizontal, longitudinally extending axes within said drying chamber and wherein the bottom portions of said walls protrude sufficiently toward each other that the radiant energy generated from the bottom portions thereof are directed in an upward and inward direction against the bottom of the objects passed along said path of travel.

12. A radiant oven comprising:

(a) a housing having an open interior with an entrance end and an exit end;

(b) conveyor means for moving successive objects along a path of travel through said oven from its entrance end to its exit end;

(c) a pair of opposed radiant emitter walls disposed within said housing and on opposite sides of said path of travel for defining a drying chamber therebetween, said walls being respectively concaved about axes which extend longitudinally within said drying chamber for directing infrared, radiant energy rays converging toward said path of travel;

(d) nozzle means disposed in said housing and respectively outwardly adjacent to said emitter walls, said nozzle means having a plurality of nozzle openings through which heated air is directed onto and against said emitter walls for heating said emitter walls; and (e) heating means for heating said air.

13. A convection stabilized radiant oven comprising:

(a) a housing having an open interior;

(b) conveyor means for moving successive objects along a path of travel through said oven from its entrance end to its exit end;

(c) a pair of spaced opposed radiant emitter walls disposed within said interior of said housing and on opposite sides of said path of travel for defining a longitudinally extending drying chamber with an entrance end and an exit end, said walls directing infrared radiant energy from said radiant emitter walls inwardly toward said path of travel when said radiant emitter walls are heated;

(d) means for heating said radiant emitter walls to prescribed temperatures for causing said radiant emitter walls to prescribed temperatures for causing said radiant emitter walls to emit sufficient radiant energy inwardly toward said path of travel to heat said objects as they pass along said path of travel;

(e) means for moving air within said drying chamber past said objects;

(f) means for sensing the temperature of said walls;

(g) control means for controlling the heating of said walls in response to the temperature sensed by said means for sensing the temperature of said walls;

(h) means for introducing heated air into said drying chamber;

(i) sensing means for sensing the temperature of the air in said drying chamber; and (j) air control means for controlling the temperature of the heated air introduced into said drying chamber for maintaining the temperature of the air sufficiently to stabilize the temperatures to which the objects are heated by said radiant energy.

14. A radiant oven comprising:

(a) a housing having an open interior with an entrance end and an exit end;

(b) conveyor means for moving successive objects along a path of travel through said oven from its entrance end to its exit end;

(c) a pair of opposed radiant emitter walls disposed within said housing an opposite sides of said path of travel for defining a drying chamber therebetween, said walls being respectively concaved about axes which extend longitudinally within said drying chamber for directing infrared, radiant energy rays converging toward said path of travel;

(d) nozzle means disposed in said housing and respectively outwardly adjacent to said emitter walls, said nozzle means having a plurality of nozzle openings through which heated air is passed for heating said emitter walls; and (e) heating means for heating said air;

(f) said nozzle means including a pair of nozzle diffusion plates which form partitions;

(g) said housing including means for enclosing said partition for defining an inner heating cavity and an outer air supplying cavity within each housing, said holes being provided through said plates; and (h) means for supplying said heated air to said outer cavities.

15. The radiant oven defined in claim 14 wherein said heating means includes a furnace externally of said housing, a blower in said furnace for supplying air to said outer cavities and duct means communicating between said furnace and said inner cavities for returning the air to said furnace.

16. The radiant oven defined in claim 12 including a longitudinally extending air discharge duct provided with longitudinally spaced ports therein opening into said drying chamber and a discharge blower communicating with said discharge duct for withdrawing the air in said duct and discharging the same externally of said housing.

17. The radiant oven defined in claim 12 including a vestibule at one end of said housing, a plenum chamber in the interior of said vestibule and means for delivering said heated air to said plenum chamber.

18. The radiant oven defined in claim 12 wherein said nozzle means include plates forming partitions between said housing and said radiant emitter walls, said plates forming partitions which separates the space between said housing and said emitter walls into inner and outer cavities, said plates defining said nozzle openings and said heated air being introduced into said outer cavities for passing inwardly into said inner cavities and against the outer surfaces of said emitter walls.

19. The radiant oven defined in claim 12 wherein said radiant walls and said plates extend substantially the entire length of including housing, said ducts disposed above said emitter walls and in the corner portions of said housing, means connected to said ducts for exhausting air through said ducts, said ducts being provided with ports which open into said drying chamber.

20. The radiant oven defined in Claim 19 wherein said ducts are provided with ports communicating with said outer cavities and through which air is withdrawn from said outer cavities and including a vestibule at one end of said housing, and a plenum within said vestibule communicating with said ducts, said plenum chamber being disposed in the upper portion of said housing, said exhaust means communicating with said plenum chamber, whereby the air from said outer cavities will heat said plenum chamber and provide preheating for objects which are passed successively through said vestibule and into said drying chamber.

21. The radiant oven defined in claim 12 wherein said heating means includes a furnace for heating said air and means for directing fresh air in a closed path through said furnace and for discharging the directed air into said drying chamber for thereby introducing fresh air in a heated condition into said drying chamber.

22. The radiant oven defined in claim 21 including duct means for passing said fresh air through said furnace and duct means for withdrawing air from said drying chamber.

23. The radiant oven defined in claim 12 including air circulating means communicating with said drying chamber for circulating air at a prescribed lower temperature than said heated air against objects placed in said drying chamber.

24. The radiant oven defined in claim 23 including means for regulating the heat of the air introduced through said nozzles and the fresh air introduced into said drying chamber for maintaining the air in said drying chamber at a lower temperature than the temperature to which the radiant emitter walls are heated by air from said nozzles.

25. A convection stabilized radiant oven comprising:

(a) a housing having a top and a pair of spaced opposed sides;

(b) a pair of concaved opposed radiant emitter walls disposed within the interior of said housing, said emitter walls defining, there between, a drying chamber;

(c) a conveyor passing through said drying chamber;

(d) means connected to said conveyor for supporting objects to be passed by said conveyor through said drying chamber;

(e) a pair of nozzle plates disposed respectively between said emitter walls and said housing walls, said nozzle plates each dividing the space between its associated side wall and its associated emitter wall into inner and outer cavities, said plate being provided with holes therethrough so that air within said outer cavities can pass inwardly through said holes and impinge against the outer sides of said emitter walls;

(f) a pair of longitudinally extending ducts disposed within said outer chambers;

(g) transversely extending ducts protruding through said radiant walls and communicating respectively with said longitudinally extending ducts;

(h) means for introducing air into said longitudinally extending ducts for delivery through said transversely disposed ducts into said drying chamber;

(i) means for heating air and for introducing this heated air into said outer cavities;

(j) means for removing air from said inner cavities; and (k) means for removing air from said drying chamber.

26. The apparatus defined in claim 25 wherein said means for heating and introducing the air into said outer cavities includes a closure, means within said closure for heating the air therein, blower means for delivering the air from said closure to said outer cavities and duct means for returning air from said inner cavities to said closure.

27. The radiant oven defined in claim 26 wherein said means for circulating said air in said drying chamber includes a plurality of fans disposed at spaced intervals above the path of travel of said objects through said drying chamber; and means for rotating said fans.

28. The radiant oven defined in claim 25 including a blower for introducing air from the exterior of said housing to said longitudinally extending ducts.

29. The oven defined in claim 28 including conduits connected to said blower, said conduits extending into said closure and thence into said outer cavities and communicating respectively with said longitudinally extending ducts, air delivered to said longitudinally extending ducts being heated by air in said conduits within said closure, prior to being delivered to said longitudinally extending ducts.

30. The oven defined in claim 25 including a pair of exhaust ducts extending longitudinally above said plates, said ducts having ports opening into said drying chamber and means for withdrawing air through said ports and said ducts and for discharging the withdrawn air..

31. The oven defined in claim 30 including a vestibule at the entrance end of said drying chamber, said vestibule being provided with a plenum chamber communicating with said exhaust ducts, the air in said exhaust ducts passing through said plenum chamber.

32. The oven defined in claim 29 wherein said conduits include a heat exchanger disposed within said closure, the air for said longitudinally extending ducts passing through said heat exchanger prior to being introduced into said longitudinally extending ducts and damper means connected to said heat exchanger for regulating the amount of heat exchanged between the air in said closure and the air being delivered to said longitudinally extending ducts.

33. The oven defined in claim 25 including sensing means for sensing the temperature of said emitter walls, control means connected to said means for heating the air within said closure and a computer for receiving signals from said sensor means and for regulating the amount of heat supplied to air within said closure.

34. The oven defined in claim 33 including second sensor means disposed within said drying chamber for sensing the temperature of air in said drying chamber and for regulating the temperature of the air introduced into said drying chamber.

35. Process of drying freshly coated objects comprising:

(a) passing said objects at spaced intervals successively along a path of travel through a drying chamber;

(b) disposing radiant emitter walls on opposite sides of said path of travel for directing radiant energy inwardly against said objects in said drying chamber;

(c) regulating the temperature of said radiant emitter walls;

(d) regulating the temperature of air within said drying chamber for maintaining a prescribed temperature within said drying chamber independent of the temperature of said radiant walls, and (e) directing said air within said drying chamber in paths to impinge upon said objects as said objects are passed between said emitter walls.

36. The process defined in claim 35 wherein the step of regulating the temperature of air within said drying chamber includes withdrawing air from said drying chamber and replacing the withdrawn air with fresh air at a rate and temperature sufficient to maintain said prescribed temperature lower than the temperature of said radiant walls.

37. The process defined in claim 35 wherein the step of replacing the withdrawn air with fresh air includes heating the fresh air and blowing the fresh heated air transversely of said path of travel inwardly into the bottom portion of said drying chamber while withdrawing air from the upper portion of said drying chamber.

38. The process defined in claim 35 wherein said step of directing said heated air in paths to impinge upon said objects includes disposing a plurality of fans above said path of travel of said objects and operating said fans so as to deliver air in a turbulent condition against said objects.

* * * * *